US008184071B2

(12) United States Patent
Hsu

(10) Patent No.: US 8,184,071 B2
(45) Date of Patent: May 22, 2012

(54) LED DRIVER CIRCUIT AND THE METHOD THEREOF

(75) Inventor: Hsiang Lin Hsu, Taoyuan County (TW)

(73) Assignee: Starchips Technology Inc., Hsin-chu (TW)

( * ) Notice: Subject to any disclaimer, the term of this patent is extended or adjusted under 35 U.S.C. 154(b) by 504 days.

(21) Appl. No.: 12/335,797

(22) Filed: Dec. 16, 2008

(65) Prior Publication Data

US 2010/0026190 A1 Feb. 4, 2010

(30) Foreign Application Priority Data

Jul. 29, 2008 (TW) ..... 97128572 A

(51) Int. Cl.
*G09G 3/14* (2006.01)

(52) U.S. Cl. ..... 345/46; 315/291; 315/294; 315/130

(58) Field of Classification Search ..... 315/291, 315/130; 345/46, 55, 102, 98, 100
See application file for complete search history.

(56) References Cited

U.S. PATENT DOCUMENTS

2005/0062685 A1 3/2005 Nogawa
2005/0264474 A1* 12/2005 Rast ..... 345/55

OTHER PUBLICATIONS

European Search Report dated Feb. 3, 2011 for 09166565.3, which is a corresponding European application, that cites US 2005/062685.

* cited by examiner

*Primary Examiner* — Douglas W Owens
*Assistant Examiner* — Jonathan Cooper
(74) *Attorney, Agent, or Firm* — WPAT, P.C.; Anthony King

(57) ABSTRACT

A method for driving a plurality of LEDs comprises the steps of: driving the plurality of LEDs according to a series of display signals; synchronously detecting the plurality of LEDs in a display mode for obtaining fault information; and serially outputting the fault information.

16 Claims, 5 Drawing Sheets

LED DRIVER CIRCUIT AND THE METHOD THEREOF

BACKGROUND OF THE INVENTION

1. Field of the Invention

The present invention relates to a driver circuit and the method thereof, and more particularly, to an LED driver circuit and the method thereof.

2. Description of the Related Art

Compared to most conventional light emitting devices, LEDs consume less power, have longer lifetime and are more durable. Therefore, most indicator devices nowadays, such as traffic signs and commercial billboards, are implemented by LEDs. However, since a large number of those large indicator devices are placed outdoors, there are various sources of hazard, such as weather, animals colliding with them, or even droppings, that can damage such LED indicator devices. Unfortunately, conventional LED indicator devices seldom exhibit fault detection mechanism. Therefore, when LED indicator device are damaged, the control device, such as a control-end processor, has no knowledge of the location and the number of the damaged LEDs, and only by human eyes can such information be observed. Since the height of many modern LED indicator devices are over tens of meters, it requires maintenance personnel to climb up high to confirm information on the damaged LED indicator device, which is an arduous task and costs a lot of money.

To solve the problems mentioned above, a fault detection mechanism can be designed for those LED indicator devices such that a control device is able to obtain the fault information of the damaged LEDs automatically. FIG. 1 shows a conventional LED driver circuit 100, which is connected to a control-end processor 200 and serves as the driver for a plurality of LEDs 400. The LED driver circuit 100 comprises a shift register 110, a plurality of latches 120, a plurality of driver units 130, a plurality of comparators 140, a plurality of state registers 150 and a state switching circuit 160, wherein the number of the flip-flops in the shift register 110, the number of the plurality of latches 120, the number of the plurality of driver units 130 and the number of the plurality of LEDs 400 are the same. The input signals of the LED driver circuit 100 include an input data, a latch signal, a switch signal and a clock signal. The output signal of the LED driver circuit 100 includes an output data. The input terminal of the LED driver circuit 100 for the input data is connected to the first flip-flop of the shift register 110. The output terminal of the LED driver circuit 100 for the output data is connected to the last flip-flop of the shift register 110.

The state switching circuit 160 determines the status of the LED driver circuit 100 according to the latch signal and the switch signal. When in a display mode, the LED driver circuit 100 receives display signals from the control-end processor 200. The received display signals are then serially stored in the shift register 110. When the storing process of the display signals is completed, the data stored in the shift register 110 is then outputted to and stored in the plurality of latches 120. The output terminals of the plurality of latches 120 are connected to the plurality of driver units 130 respectively. The plurality of driver units 130 have their output terminals connected to, and accordingly drive, the plurality of LEDs 400.

When in a debug mode, the LED driver circuit 100 receives fault-detecting signals (such as the signals of which the bits are all 0s or all 1s) from the control-end processor 200. The received fault-detecting signals are then serially stored in the shift register 110. When the storing process of the fault-detecting signals is complete, the data stored in the shift register 110 is then outputted to and stored in the plurality of latches 120 so as to be the input signal for the plurality of driver units 130. The input terminals of the plurality of comparators 140 are respectively connected to the output terminals of the plurality of LEDs 400 and a reference voltage. The output signals of the comparators 140 indicate whether the plurality of LEDs 400 are in fault state. The plurality of state registers 150 store the comparison results of the plurality of comparators 140, and then stores such results to the shift register 110 at a later time such that the results can be outputted and transmitted back to the control-end processor 200. The control-end processor 200 obtains the fault information of the plurality of LEDs 400 according to the comparison results. For instance, if the fault-detecting signal is a signal of which the bits are all 1s, which should turn on all the plurality of LEDs 400, and the comparison results contain bits of "0", then the control-end processor 200 determines that the LEDs 400 at the corresponding locations are faulty.

FIG. 2 shows the waveforms of the input and output signals of the LED driver circuit 100. As shown in FIG. 2, the clock signal controls the input operation of the shift register 110. When in the display mode, the display signals are serially stored into the shift register 110. At such point, the output signals of the LED driver circuit 100 are redundant data. When the storing process of the display signals is complete, a pulse of the latch signal triggers the data stored in the shift register 110 to be stored into the plurality of latches 120. The switch signal then switches to low to activate the plurality of driver units 130, and the plurality of LEDs 400 are driven thereby according to the data stored in the plurality of latches 120. At such point, the output signal is the display signals. After the state switching circuit 160 switches the mode of the LED driver circuit 100 to the debug mode, the driver circuit 100 is ready for the fault detection of the plurality of LEDs, or is ready to transmit the data stored in the plurality of state registers 150 back to the control-end processor 200. At such point, the output signal is the fault information. As shown in FIG. 2, the modes of the driver circuit 100 further include an exit mode, which serves as an interfacing mode between the display mode and the debug mode.

However, the aforesaid prior art needs to be switched between several modes, which heavily increases the control complexity for the control-end processor 200. Moreover, the addition of the plurality of state registers 150 and the state switching circuit 160 increases the hardware cost. Therefore, there is a need to design a display mechanism, which not only can detect the fault status of the plurality of LEDs synchronously, but also does not increase the hardware cost.

SUMMARY OF THE INVENTION

The method for driving a module including a plurality of LEDs according to one embodiment of the present invention comprises the steps of: driving the plurality of LEDs according to a series of display signals; synchronously detecting the plurality of LEDs in a display mode for obtaining fault information; and serially outputting the fault information.

The LED driving method according to another embodiment of the present invention comprises the steps of: serially inputting a series of display signals to a shift register; storing the data stored in the shift register to a plurality of latches; driving a plurality of LEDs according to the data stored in the plurality of latches; synchronously storing fault information of LEDs to the shift register when the plurality of LEDs display the data stored in the plurality of latches; and serially outputting the fault information to determine the fault status of the plurality of LEDs.

The LED driver circuit according to another embodiment of the present invention comprises a shift register, a plurality of latches, a plurality of driver units and a plurality of fault-detecting units. The shift register receives display signals from a control-end processor and transmits fault information to the control-end processor. The plurality of latches secure the output signals from the shift register. The plurality of driver units receive the data stored in the plurality of latches and drive a module comprising a plurality of LEDs. The plurality of fault-detecting units synchronously detect the plurality of LEDs in a display mode for obtaining fault information and store the fault information into the shift register.

BRIEF DESCRIPTION OF THE DRAWINGS

The objectives and advantages of the present invention will become apparent upon reading the following description and upon referring to the accompanying drawings of which.

DETAILED DESCRIPTION OF THE INVENTION

Figure 1:
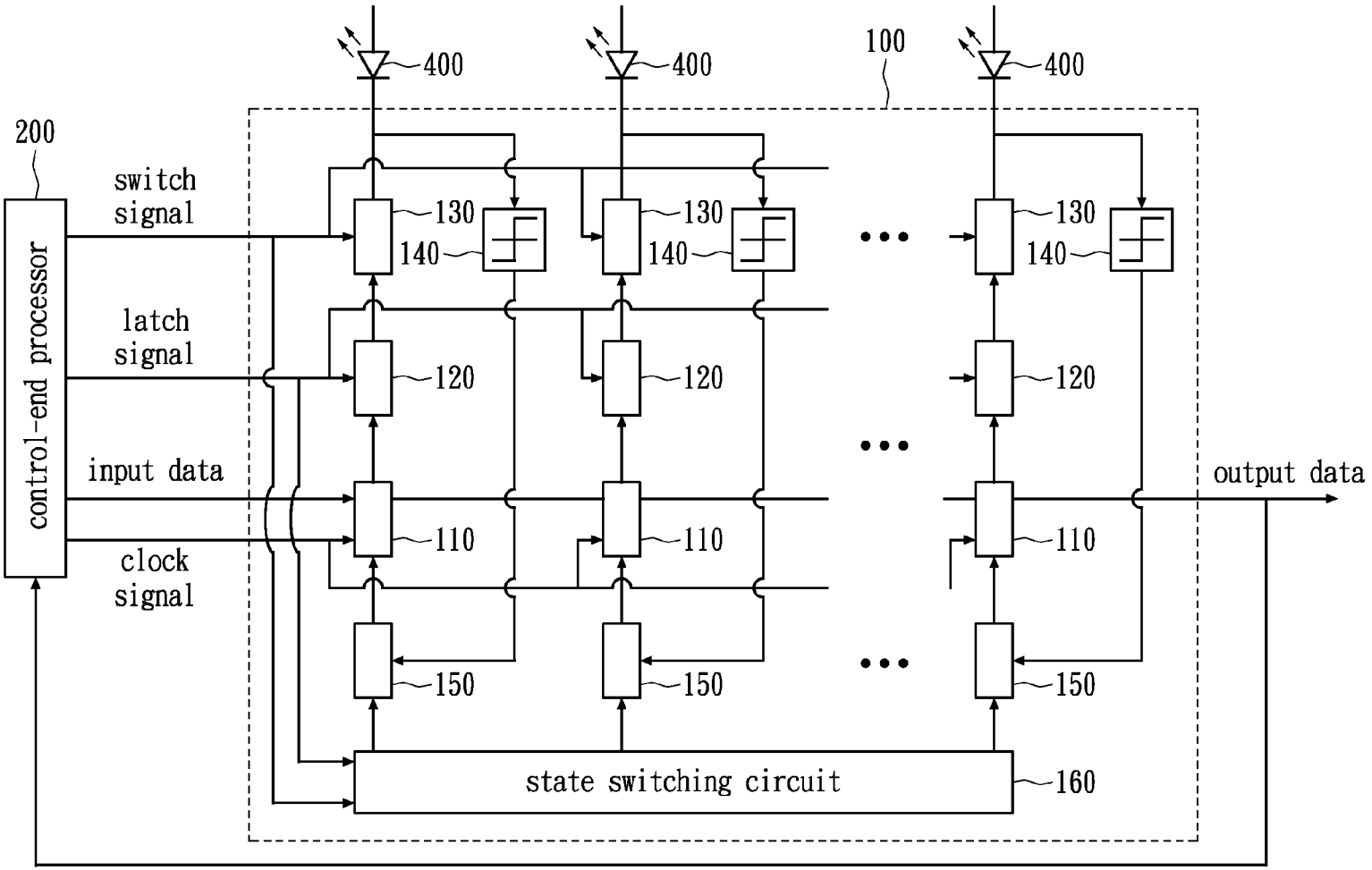
FIG. 1 (Prior Art)
FIG. 1 shows a conventional LED driver circuit.
Figure 2:
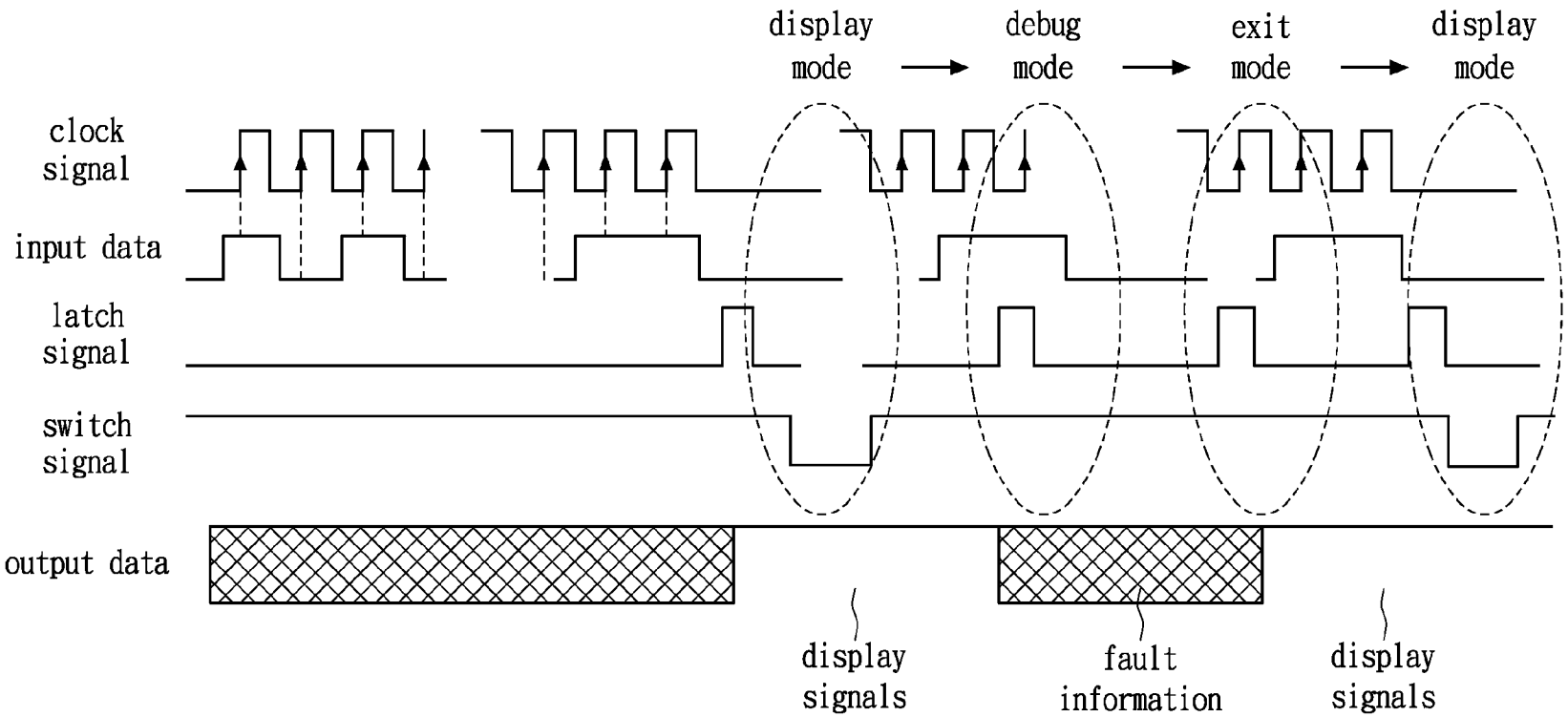
FIG. 2 (Prior Art)
FIG. 2 shows waveforms of the input and output signals of the LED driver circuit according to one embodiment of the present invention.
Figure 3:
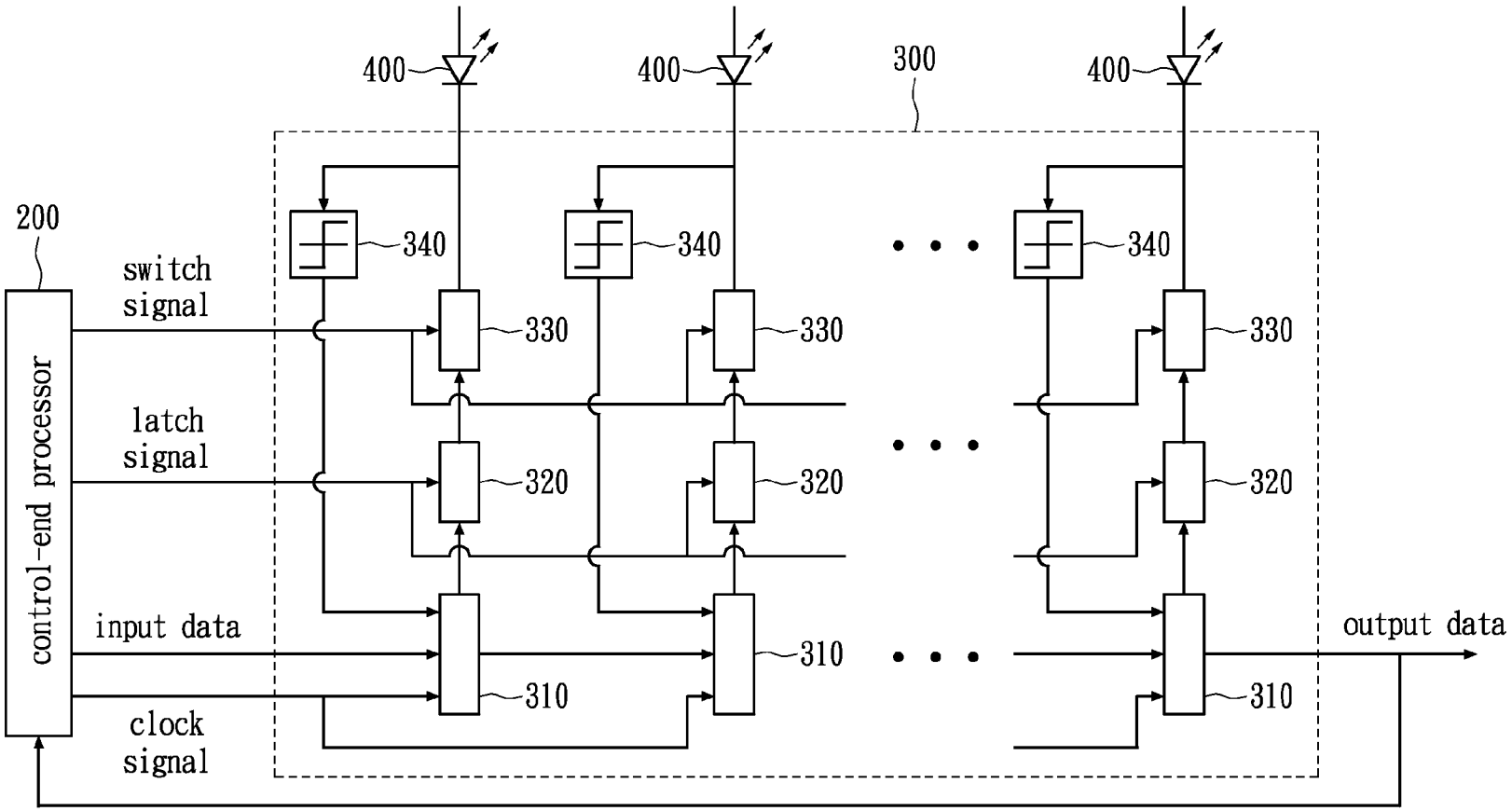
FIG. 3 shows an LED driving method and the circuit thereof according to one embodiment of the present invention.

FIG. 3 shows an LED driving method and the circuit thereof according to one embodiment of the present invention. The LED driver circuit 300 is connected to the control-end processor 200, and serves as the driver for the plurality of LEDs 400. The LED driver circuit 300 comprises a shift register 310, a plurality of latches 320, a plurality of driver units 330 and a plurality of fault-detecting units 340, such as comparators, wherein the number of the flip-flops in the shift register 310, the number of the plurality of latches 320, the number of the plurality of driver units 330, the number of the fault-detecting units 340 and the number of the plurality of LEDs 400 are the same. The input signals of the LED driver circuit 300 include an input data, a latch signal, a switch signal and a clock signal. The output signal of the LED driver circuit 300 includes an output data. The input terminal of the LED driver circuit 300 for the input data is connected to the first flip-flop of the shift register 310. The output terminal of the LED driver circuit 300 for the output data is connected to the last flip-flop of the shift register 310.

The LED driving method according to the embodiment of the present invention comprises only one mode, i.e., the display mode. Therefore, the state switching circuit 160 in the conventional LED driver circuit 100 is not required. When in the display mode, the LED driver circuit 300 receives the display signals from the control-end processor 200. The received display signals are then serially stored in the shift register 310. When the storing process of the display signals is completed, the data stored in the shift register 310 is then outputted to and stored in the plurality of latches 320. The output terminals of the plurality of latches 320 are connected to the plurality of driver units 330, respectively. The plurality of driver units 330 have their output terminals connected to, and accordingly drive, the plurality of LEDs 400. The input terminals of the plurality of comparators 340 are respectively connected to the output terminals of the plurality of LEDs 400 and a reference voltage. The output signals of the comparators 340 indicate whether the plurality of LEDs 400 are in fault state. The plurality of comparators 340 can detect two kinds of fault states of the plurality of LEDs 400, i.e., whether the plurality of LEDs 400 are stuck short or stuck open. For instance, if the display signals stored in the plurality of latches 320 contain a bit of "1", and the corresponding bit of the output signals of the plurality of comparators 340 is "0", then the corresponding LED 400 is stuck open. If the display signals stored in the plurality of latches 320 contain a bit of "0", and the corresponding bit of the output signals of the plurality of comparators 340 is "1", then the corresponding LED 400 is stuck short. After the plurality of LEDs 400 are driven and activated, the plurality of comparators 340 store the comparison results into the shift register 310 before the next clock signal pulse arrives. The comparison results are then outputted serially from the output terminal of the LED driver circuit 300. That is, the LED driving method according to the embodiment of the present invention combines fault detection mechanism with the display mode such that the fault information of being stuck short and open is transmitted back to the control-end processor 200 in real time.

Figure 4:
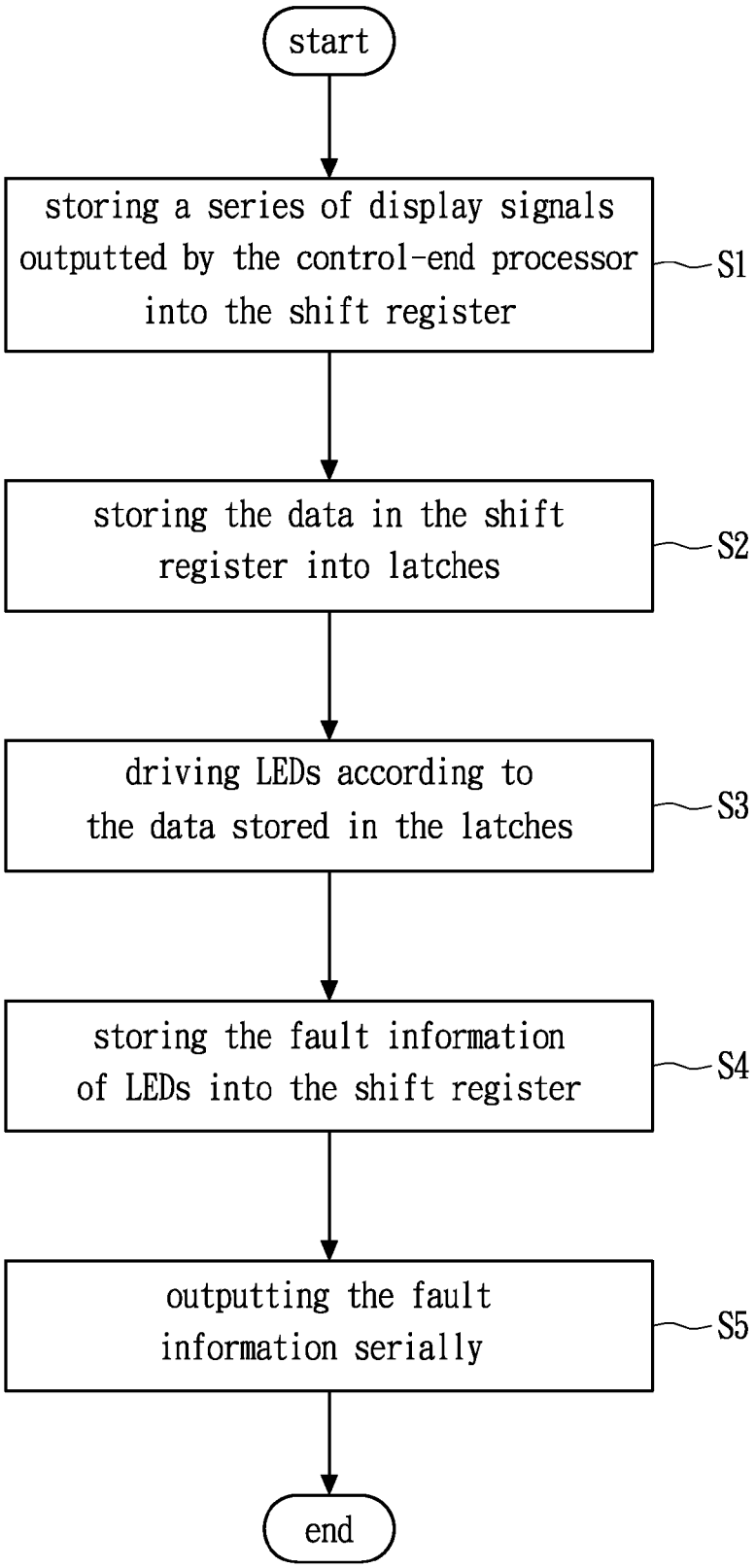
FIG. 4 shows the flow chart of an LED driving method according to the embodiment of the present invention.

FIG. 4 shows the flow chart of an LED driving method according to the embodiment of the present invention. In step S1, a series of display signals outputted by the control-end processor 200 are stored in the shift register 310. In step S2, the data stored in the shift register 310 is stored into the plurality of latches 320. In step S3, the plurality of LEDs 400 are driven according to the data stored in the plurality of latches 320. In step S4, the fault information of the plurality of LEDs 400 is stored into the shift register 310. In step S5, the LED driver circuit 300 serially outputs the comparison results.

Figure 5:
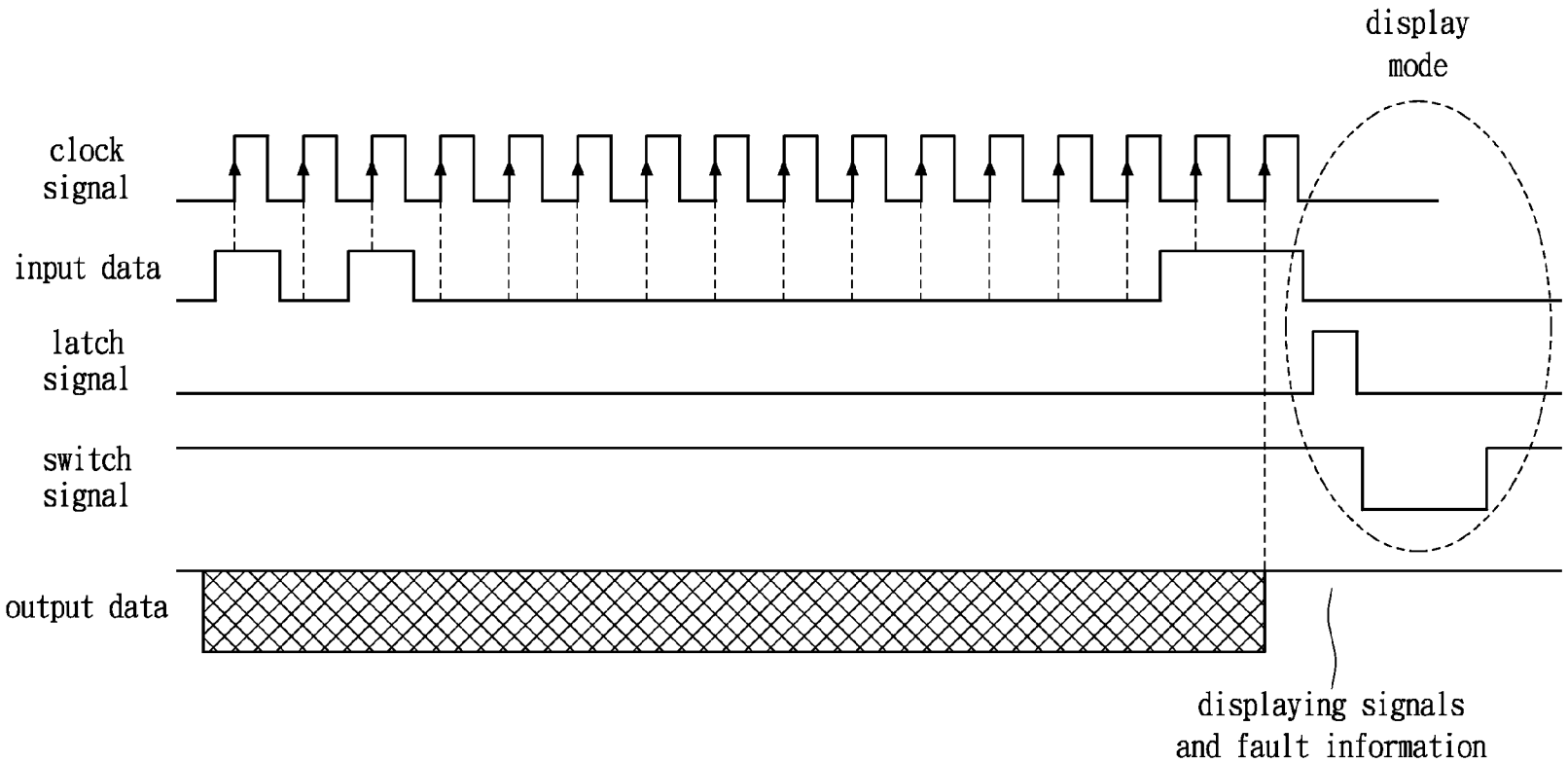
FIG. 5 shows waveforms of the input and output signals of the LED driver circuit according to one embodiment of the present invention.

FIG. 5 shows the waveforms of the input and output signals of the LED driver circuit 300. As shown in FIG. 5, the clock signal controls the input operation of the shift register 310. When in display mode, the display signals are serially stored into the shift register 310. When the storing process of the display signals is completed, a pulse of the latch signal triggers the data stored in the shift register 310 to be stored into the plurality of latches 320. The switch signal then switches to low to activate the plurality of driver units 330, and the plurality of LEDs 400 are driven thereby according to the data stored in the plurality of latches 320. The fault information of the plurality of comparators 340 is stored into the shift register 310 before the next clock signal pulse arrives. At such point, the output signal is the comparison results, i.e., the fault information. As shown in the preceding paragraph, after the LED driver circuit 300 receives the display signals and drives the plurality of LEDs 400, the fault information of the plurality of LEDs 400 is outputted in real time. Therefore, the plurality of state registers 150 of the conventional LED driver circuit 100 are not required in the LED driver circuit 300.

The control-end processor 200 compares the received fault information to the corresponding display signals to obtain the fault status of the plurality of LEDs 400. If the display signals are inconsistent with the corresponding fault information, the corresponding LEDs are determined to have been stuck open or short.

In conclusion, the LED driving method and the circuit thereof according to embodiments of the present invention combine the fault detection mechanism with the display mode, and therefore the hardware costs can be reduced. On the other hand, the fault information can be transmitted back to the control device in real time, and hence the fault status of the faulty LEDs can be discovered sooner. In addition, the LED driving method and the circuit thereof according to embodiments of the present invention are capable of driving of the plurality of LEDs and detecting stuck open and/or stuck short at the same time. Therefore, the control device does not need to switch between different modes, and hence the control complexity is reduced.

The above-described embodiments of the present invention are intended to be illustrative only. Those skilled in the art may devise numerous alternative embodiments without departing from the scope of the following claims.

What is claimed is:

1. A method for driving a module including a plurality of light emitting diodes (LEDs), comprising the steps of:

driving the plurality of LEDs according to a series of display signal; synchronously detecting the plurality of LED's for obtaining fault information to a shift register directly from a comparator when the plurality of LEDs displays the data stored in a plurality of latches in a display mode, wherein the fault information represents whether the plurality of LEDs are short circuit or open circuit; and serially outputting the fault information when serially inputting the display signals in the display mode.

2. The method of claim 1, wherein the display signals are not predetermined fault-detecting signals.

3. The method of claim 1, wherein the fault information is detected by comparing output currents of the plurality of LEDs to a reference current.

4. The method of claim 1, further comprising the step of comparing the fault information to the display signals by a control-end processor, wherein the processor outputs the display signals.

5. An LED driving method comprising the steps of:

serially inputting a series of display signals to a shift register;

storing data in the shift register to a plurality of latches;

driving a plurality of LEDs according to the data in the plurality of latches;

synchronously detecting the plurality of LEDs for obtaining fault information and storing the fault information to the shift register directly from a comparator when the plurality of LEDs displays the data stored in the plurality of latches in a display mode, wherein the fault information represents whether the plurality of LEDs are short circuit or open circuit; and serially outputting the fault information from the shift register when serially inputting the display signals to the shift register in the display mode.

6. The LED driving method of claim 5, wherein the display signals are not predetermined fault-detecting signals.

7. The LED driving method of claim 5, wherein the input and output operations of the shift register are controlled by a clock signal.

8. The LED driving method of claim 7, wherein after the driving step, the synchronously storing step is executed before the next pulse of the clock signal.

9. The LED driving method of claim 5, wherein the number of flips-flops in the shift register, the number of latches and the number of LEDs are the same.

10. An LED driver circuit, comprising:

a shift register configured to receive display signals from a control-end processor and to transmit fault information to the control-end processor;

a plurality of latches configured to latch output signals from the shift register;

a plurality of driver units configured to receive data stored in the plurality of latches and to drive a module comprising a plurality of LEDs; and a plurality of fault-detecting units configured to synchronously detect the plurality of LEDs for obtaining fault information and to store the fault information directly from a comparator into the shift register in a display mode, wherein the fault information represents whether the plurality of LEDs are short circuit or open circuit;

wherein the shift register is configured to serially output the fault information from the shift register when serially input the display signals to the shift register in the display mode.

11. The LED driver circuit of claim 10, wherein the display signals are not predetermined fault-detecting signals.

12. The LED driver circuit of claim 10, wherein the fault information is detected by comparing output currents of the plurality of LEDs to a reference current.

13. The LED driver circuit of claim 10, wherein the fault information is stored in the shift register before the shift register receives the next display signals.

14. The LED driver circuit of claim 10, wherein the shift register outputs the fault information and receives the next display signals at the same time.

15. The LED driver circuit of claim 10, wherein the number of flips-flops in the shift register, the number of the latches and the number of the LEDs are the same.

16. The LED driver circuit of claim 10, wherein the number of the fault-detecting units is the same as the number of the LEDs.

* * * * *